US005263781A

United States Patent [19]

Mima et al.

[11] Patent Number: 5,263,781

[45] Date of Patent: Nov. 23, 1993

[54] THERMAL TRANSFER PRINTING METHOD AND PRINTING APPARATUS EMPLOYED THEREFOR

[75] Inventors: Soichiro Mima, Nishinomiya; Noboru Katakabe, Uji; Kouji Ikeda, Katano, all of Japan

[73] Assignee: Matsushita Electric Industrial Co., Ltd., Osaka, Japan

[21] Appl. No.: 824,520

[22] Filed: Jan. 23, 1992

[30] Foreign Application Priority Data

Jan. 24, 1991 [JP] Japan ..... 3-007006

[51] Int. Cl.[5] ..... B41J 2/00

[52] U.S. Cl. ..... 400/120; 346/135.1

[58] Field of Search ..... 400/120; 346/135.1, 346/136; 156/387

[56] References Cited

U.S. PATENT DOCUMENTS

| | | | |
|---|---|---|---|
| 3,717,881 | 2/1973 | Bunning | 346/136 |
| 4,687,701 | 8/1987 | Kniesch et al. | 400/120 |
| 4,819,010 | 4/1989 | Kohashi et al. | 400/120 |
| 4,844,770 | 7/1989 | Shiraishi et al. | 400/120 |
| 4,882,593 | 11/1989 | Touma et al. | 400/120 |
| 4,887,095 | 12/1989 | Wataya et al. | 400/120 |
| 4,930,417 | 6/1990 | Isobe | 400/120 |
| 5,005,028 | 4/1991 | Tamura et al. | 400/120 |
| 5,010,352 | 4/1991 | Takei et al. | 400/120 |

FOREIGN PATENT DOCUMENTS

| | | |
|---|---|---|
| 0378291 | 7/1990 | European Pat. Off. . |
| 62-68788 | 3/1987 | Japan . |
| 63-17086 | 1/1988 | Japan . |
| 63-17087 | 1/1988 | Japan . |
| 63-17088 | 1/1988 | Japan . |
| 63-17091 | 1/1988 | Japan . |

*Primary Examiner*—Edgar S. Burr
*Assistant Examiner*—Ren Yan
*Attorney, Agent, or Firm*—Wenderoth, Lind & Ponack

[57] ABSTRACT

A thermal transfer printing method includes the steps of overlapping a surface of a printing layer of an intermediate transfer member having the printing layer on a base member with an ink sheet. Thermal transfer printing from the ink sheet to the printing layer is effected, subsequently overlapping the intermediate transfer member with an image receiver for transfer of the printing layer onto the image receiver. Thereafter, the printing layer is fixed on the image receiver by causing the printing layer to penetrate into the image receiver through direct application of pressure and heat to the printing layer on the image receiver. A printing apparatus is employed for effecting the thermal transfer printing method.

14 Claims, 4 Drawing Sheets

THERMAL TRANSFER PRINTING METHOD AND PRINTING APPARATUS EMPLOYED THEREFOR

BACKGROUND OF THE INVENTION

The present invention generally relates to a printing method, and more particularly, to a thermal transfer printing method for effecting printing on a paper sheet or the like by a printing means such as a thermal head, etc. through employment of an ink material containing at least a coloring material, and a printing apparatus employed for executing the method.

Recently, with respect to the thermal transfer printing method and printing apparatus for effecting such a method as referred to above, there has been proposed an arrangement in which, for example, through employment of an ink sheet prepared by forming an ink material layer of about 3μ thick with a hot-melt binder material and a pigment coloring material, on a surface of a heat-resistant base material such as a polyethylene terephthalate (referred to as PET hereinafter) film and condenser paper or the like, the ink material is adapted to be directly fused and transferred onto a recording medium by a receiving head, to thereby obtain a recorded item.

Where the coloring material is composed of a subliming dye which is to be transferred for printing by sublimation or heat diffusion, there have also been known a thermal transfer printing method and a printing apparatus therefor in which, similarly, with use of an ink sheet prepared by forming an ink material layer containing a subliming dye and a binder material, on the surface of the heat-resistant base material such as PET film, condenser paper or the like, the subliming dye as the coloring material is directly transferred onto a recording medium having a dyeing property or dye affinity by a printing head so as to obtain a recorded item.

One example of the conventional thermal transfer printing methods and printing apparatuses as referred to above will be explained below with reference to FIG. 4.

In FIG. 4, the known thermal transfer printing apparatus generally includes an ink sheet 6, a thermal head 8, and a printing signal source 21 connected to the thermal head 8. The ink sheet 6, made by disposing an ink material layer 5 composed of a coloring material and a binder material on a heat-resistant base member 4, and an image receiver 11, such as recording paper or the like, are held under pressure between the thermal head 8 and a platen 7 while the thermal head 8 is heated according to the signal from the printing signal source 21 to thereby selectively raise the temperature of the ink material. The image receiver 11 is transported in a direction of an arrow 52 through a set of transport rollers 51, while the ink sheet 6 is transported in a direction of an arrow 53 by an ink sheet winding roller 10. When the ink sheet 6 is separated from the image receiver 11, part of the coloring material of the ink material layer 5 is transferred onto the image receiver 11 to thereby provide a printed image 54 on the image receiver.

The conventional thermal transfer printing apparatus as described above is arranged to effect the thermal transfer printing onto the image receiver through a temperature rise of the ink material layer.

In the case of subliming transfer, in which the coloring material composed of the subliming dye is transferred by sublimation or heat diffusion, the transfer printing becomes possible only when the surface material of the image receiver is of a material with a dye property or affinity for dye, and therefor the transfer printing sensitivity markedly differs according to the surface materials of the image receiver. For example, if general paper sheets are employed for the image receiver, the printed image by the transfer of dye is hardly obtainable. Moreover, the printing sensitivity also varies depending on the contact state between the ink sheet and the image receiver. For example, in an image receiver having a surface with concave and convex portions or undulations, poor contact between the ink material layer and the image receiver takes place, thus making it impossible to provide a uniform printed image.

On the other hand, in the case of a melting transfer in which the ink material layer is melted for a low viscosity by the temperature rise, the printing tends to be affected by the state of contact between the ink sheet and the image receiver. For example, when a plain paper sheet used for copying apparatus or the like is utilized for the image receiver, the surface thereof has undulations of at least 25 μm or thereabout, due to the presence of the fibers of the paper, whereas the thickness of the ink material layer of the general ink sheet is several μm. Accordingly, when such a plain paper sheet is used for an image receiver, contact between the ink material layer and the image receiver becomes non-uniform, and thus favorable printing images cannot be obtained. Furthermore, since the ink material recorded by the melting transfer has little adhesion with respect to the paper, the strength of the printed image with respect to friction on the surface of the image receiver (i.e. the fixing characteristic of the image) is very poor.

SUMMARY OF THE INVENTION

Accordingly, an essential object of the present invention is to provide a thermal transfer printing method which is capable of providing a printed image favorable in image quality and with a high fixing characteristic in printing by subliming transfer and melting transfer, irrespective of the kinds of the image receivers or surface materials and surface states thereof.

Another object of the present invention is to provide a thermal printing apparatus for effecting the thermal transfer printing method as described above which is simple in construction and stable in function with a high reliability, and which can be readily manufactured at low cost.

In accomplishing these and other objects according to the present invention, there is provided a thermal transfer printing method which includes the steps of overlapping a surface of a printing layer of an intermediate transfer member having a printing layer on a base member with an ink sheet, effecting thermal transfer printing from the ink sheet to the printing layer, subsequently overlapping the intermediate transfer member with an image receiver for transfer of the printing layer onto the image receiver, and thereafter fixing the printing layer on the image receiver by causing the printing layer to penetrate into the image receiver through direct application of pressure and heat to the printing layer on the image receiver.

The printing layer can be fixed by pressure only, or by heat only, or by a combination of the two. Preferably, the printing layer is fixed by a pressure roller that has a surface covered with silicone rubber. The printing layer is formed by, at least, polyvinylbutyral.

According to the present invention, there is further provided a printing apparatus which includes an ink sheet, an intermediate transfer member having a printing layer on one surface of a base member, a printing means for effecting thermal transfer printing from the ink sheet to the printing layer, a transfer means for transferring the printing layer onto an image receiver in a state where the intermediate transfer member is overlapped with the image receiver, and a fixing means for fixing the printing layer to penetrate into the image receiver through direct application of pressure and heat to the printing layer on the image receiver.

The fixing means, as discussed above, can fix the printing layer by either applying only pressure or applying only heat, or applying a combination thereof. Further, the fixing means preferably comprises a pressure roller having a surface covered with silicone rubber. The printing layer, as noted above, comprises at least polyvinylbutyral.

In the arrangement according to the present invention as described so far, a primary printed image is first formed on the printing layer of the intermediate transfer member. Subsequently, by heating and depressing the printing layer onto the surface of the image receiver, the printing layer and the primary printed image are transferred onto the surface of the image receiver so as to form the transferred image thereon. Thereafter, the printing layer is softened by heating from above the printing layer, and through further depression thereof by a soft rubber material, the printing layer is fixed on the image receiver.

Accordingly, the printed image can be transferred onto any image receiver on which the printing layer is imparted with the transferability. For example, in the case of the subliming transfer, since the image is formed on a printing layer having a dyeing property, and such printing layer is further transferred onto an image receiver such as plain paper sheets or the like, special paper particularly having the dyeing property, such as coated paper and the like, is not required, and in principle recording may be effected on any recording paper, including plain paper sheets.

With respect to the quality of the recorded images, it becomes possible to achieve uniform contact among the thermal head, ink sheet and intermediate transfer member, and printing at a high image quality may be achieved through subliming transfer, melting transfer, etc. for the printing layer on the intermediate transfer member. By transferring such printed images onto an image receiver with a rough surface, high image quality printing may be effected on the image receiver on which uniform printing could not be effected due to the rough surface.

Since part of the printing layer of the intermediate transfer member is generally uniformly transferred onto the recorded image surface of the receiver, there is no possibility that the coloring material is directly rubbed even with respect to friction on the surface of the image receiver (e.g. rubbing by fingers, etc.), and thus, recorded images favorable in the fixing characteristic can be obtained.

By fixing the printing layer onto the image receiver by pressure, heat, or pressure and heat, the printing layer is filled into concave portions of the surface of an image receiver having concave and convex portions due to the presence of fibers, etc.

Particularly where the surface of the image receiver has concave and convex portions due to presence of fibers and the like, by fixing the heated and softened printing layer onto the image receiver through further depression of the printing layer by a soft rubber material, the printing layer is filled into the concave portions. Upon further pressurization, the soft rubber enters the concave portions, with the printing layer penetrated into the interior of the fine material fibers. Accordingly, in the surface state, the rough undulation of the image receiver may be reproduced. Since the luster and writing characteristic on the surface of the image receiver depends on the rough undulation on the surface, the luster and writing characteristic on the surface of the printing layer shows the same state as in the original surface of the image receiver. Therefore, any unnatural appearance at the portion where only the non-colored printing layer is present on the image receiver without recording of the image may be eliminated, and characters, etc. may be written from above the printing layer by pencils, etc. Moreover, since the printing layer is rigidly fixed on the image receiver, the fixing characteristic of the printed image can be further improved.

If the heating is effected at temperatures above the flow softening point of a thermo-plastic resin contained in the printing layer, the printing layer is further softened to have fluidity to thereby penetrate into the interior of the concave portions on the surface of the image receiver. Therefore, through pressurization under a small pressure by a material having a parting or releasing nature, the surface of the image receiver reproduces the state with the rough undulations in a similar manner as described earlier.

As described so far, it is possible to obtain printed images having dye, pigment, etc. as the coloring material, with favorable image quality and superior writing and fixing characteristics, without depending on the kind of image receivers and the type of surface material, surface state, etc. employed.

BRIEF DESCRIPTION OF THE DRAWINGS

The above and other objects and features of the present invention will become apparent from the following description of a preferred embodiment thereof with reference to the accompanying drawings, in which.

DETAILED DESCRIPTION OF THE INVENTION

Figure 1:
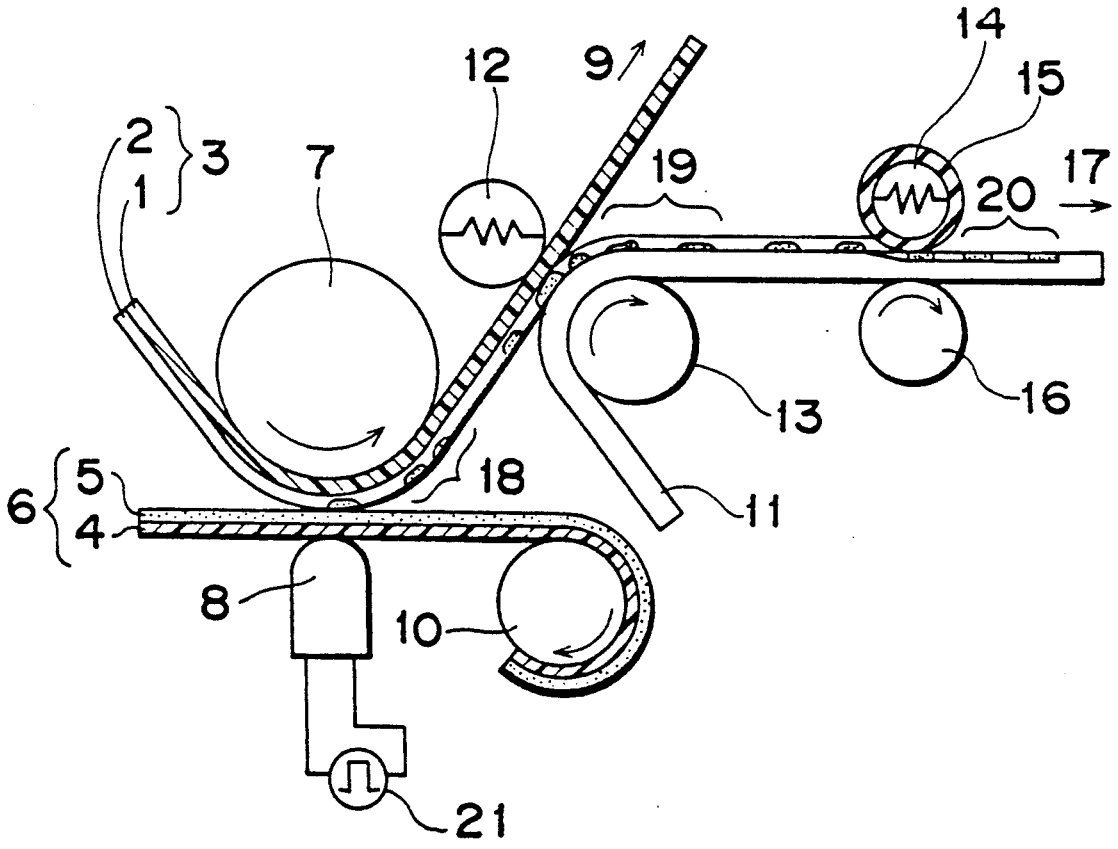
FIG. 1 is a schematic side elevational view, partly in section, of a thermal transfer printing apparatus according to one preferred embodiment of the present invention.

Before the description of the present invention proceeds, it is to be noted that like parts are designated by like reference numerals through the accompanying drawings.

Referring to FIG. 1, there is shown a thermal transfer printing apparatus according to one preferred embodiment of the present invention, which generally includes an intermediate transfer member 3 and an ink sheet 6 held under pressure between a platen 7 and a thermal head 8 as a printing means connected to a printing signal source 21. A heating roller 12 and an A roller 13 as a transfer means hold the intermediate transfer member 3 and an image receiver 11, e.g. a printing paper sheet, therebetween. A pressure roller 14 and a B roller 16 as a fixing means depress a printing layer 2 onto the image receiver 11 for obtaining a fixed image 20 in a manner described in detail hereinafter.

In FIG. 1, the intermediate transfer member 3 is constituted by a heat-resistant A base material 1 in the form of a sheet and the printing layer 2 provided on the A-base material 1. Similarly, the ink sheet 6 is composed of a heat-resistant B base material 4 in the form of a sheet and an ink material layer 5 provided on the B base material 4

By the above arrangement of FIG. 1, in a state where the intermediate transfer member 3 and the ink sheet 6 are held under pressure between the platen 7 and the thermal head 8, the thermal head 8 is selectively heated by the signal from the printing signal source 21, and at least part of the coloring material of the ink material layer 5 is transferred onto the surface of the printing layer 2 of the intermediate member 3 to thereby form on the intermediate transfer member 3 a primary printed image 18 corresponding to the printing signal. Subsequently, through rotation of the platen 7, the intermediate transfer member 3 is transported in a direction indicated by an arrow 9, while the ink sheet 6 is wound onto a roller 10 as shown.

Thereafter, with the intermediate transfer member 3 and the image receiver 11 being piled one upon another and held between the heating roller 12 and the A roller 13, when the base member side of the intermediate transfer member 3 is entirely heated over all its surface by the heating roller 12, the printing layer 2 is softened and stuck to the surface of the image receiver 11. Accordingly, upon separation between the intermediate transfer member 3 and the image receiver 11, the printing layer 2 at the heated portions is torn off from other portions to be transferred onto the side of the image receiver 11, and thus the primary printed image 18 is transferred onto the surface of the image receiver 11 to form a transferred image 19 thereon. The image receiver 11 thus treated is transported in a direction indicated by an arrow 17 through rotation of the A roller 13.

Subsequently, the image receiver 11 is held between the pressure roller 14 and the B roller 16, and the printing layer 2 is forced under pressure into the image receiver 11, and thus, a fixed image 20 is obtained on the image receiver 11.

Since the fixed image 20 becomes an inverted image of the primary printed image 18, the printing signal source 21 normally produces the signal as will print the inverted image of the fixed image 20 by the thermal head 8.

For color printing, for example, through employment of the ink sheet 6, in which the ink material layer 5 in three primary colors of cyan, magenta, and yellow by dyes, pigments or mixture thereof, or in four primary colors further provided with black, is disposed on the base member 4 in a face order, by transferring the colors onto the intermediate transfer member 3 in an overlapped state in the face order, a printed image in color may be obtained.

Figure 2:
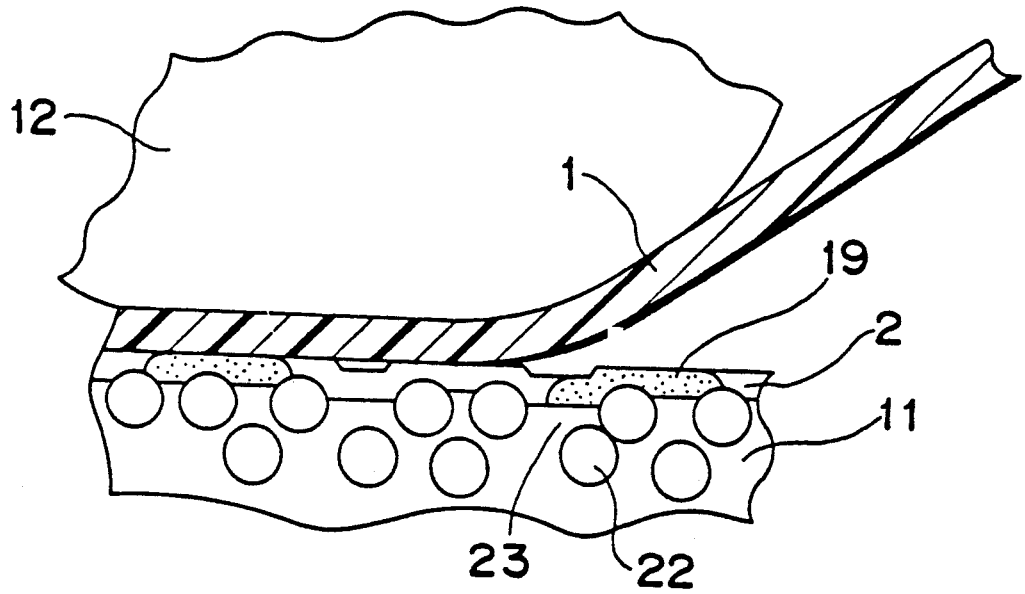
FIG. 2 is a fragmentary side sectional view on an enlarged scale of an essential portion of the printing apparatus of FIG. 1, showing the state of a transferred image formation for explaining the functioning of the apparatus.
Figure 3:
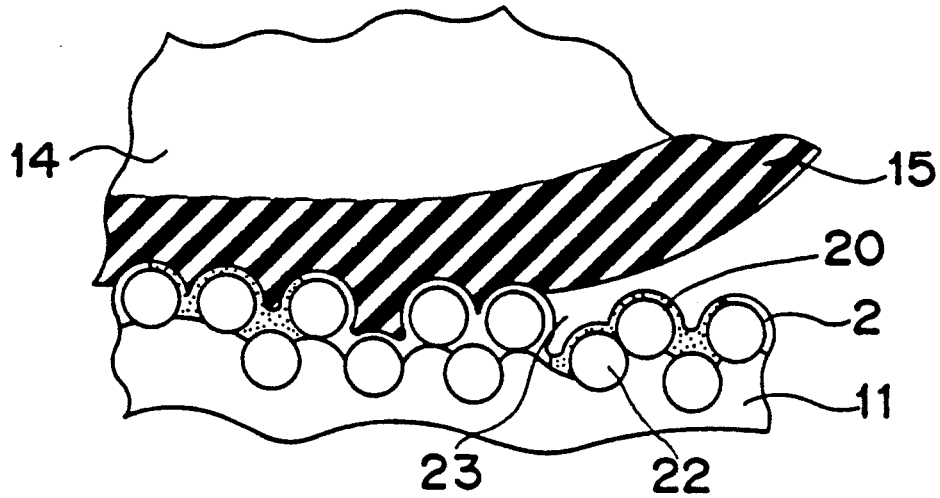
FIG. 3 is a view similar to FIG. 2, which particularly shows the state of a fixed image formation thereof.
Figure 4:
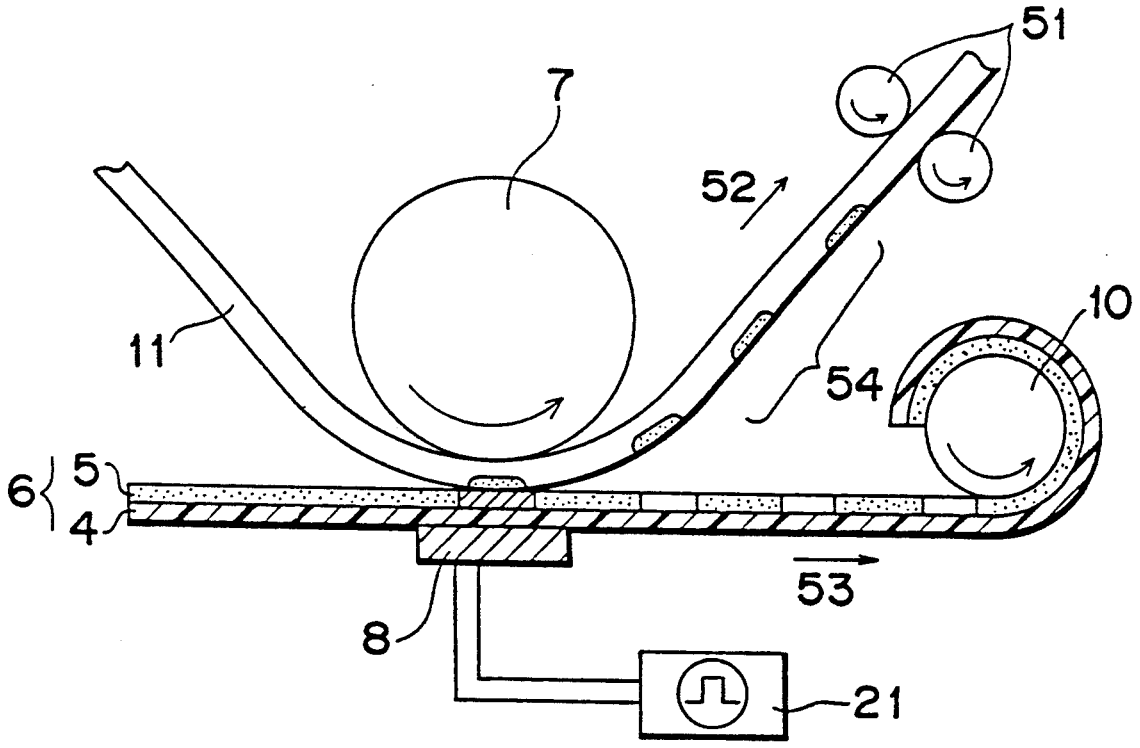
Fig. 4 PRIOR ART
FIG. 4 is a view similar to FIG. 1, which particularly relates to a conventional thermal transfer printing apparatus (already referred to)

FIG. 2 is a schematic diagram showing the state in which the transferred image 19 is formed in the arrangement of FIG. 1, while FIG. 3 is also a schematic diagram showing the state where the fixed image 20 is formed in the arrangement of FIG. 1. The mechanisms for the transfer and fixing will be explained below with reference to FIGS. 2 and 3.

In FIG. 2, when the side of the A base member 1 of the intermediate transfer member 3 is heated over all its surface by the heating roller 12, the printing layer 2 is softened so as to stick to the surface of the image receiver 11. Upon separation of the intermediate transfer member 3 the image receiver 11, the printing layer 2 at the heated portions is broken off from other portions and transferred onto the side of the image receiver 11, to thereby form the transferred image 19 on the surface of the image receiver 11. In the above case, if the surface of the A base material 1 is smooth, the transferred printing layer surface is comparatively smooth, while in the case where the surface of the image receiver 11 has convex and concave portions by the presence of fibers 22, etc., as shown in FIG. 2, part of the printing layer 2 falls slightly into the concave portion 23. Accordingly, although the printing layer 2 is transferred onto the image receiver 11, the adhering area is limited to the convex portions of the image receiver 11 and is not very large, with a consequent weak adhering force, while its surface is comparatively smooth, having some luster.

In FIG. 3, the printing layer 2 is fixed to the image receiver 11 through pressurization from above the printing layer 2 on the image receiver 11 by the pressure roller 14 provided with a rubber-like layer 15 on the outer peripheral face thereof. Where the surface of the image receiver 11 has concave and convex portions or undulations due to the presence of fibers 22 and the like, the printing layer 2 is filled into the concave portions 23, and upon further depression, the soft rubber-like material enters the interior of the concave portions 23, with the printing layer 2 further penetrating into fine inner portions of the material fibers. Accordingly, the state of the surface reproduces rough concave and convex portions similar to those in the original surface of the image receiver as shown in FIG. 3.

Generally, the luster and writing characteristics on the surface of the image receiver 11 depends on the rough concave and convex portions on the surface, and when the surface quality of the image receiver 11 is rough as in a plain paper sheet, there is no luster, with superior writing characteristics. However, if the surface is comparatively smooth, as with the printing layer 2 including the transferred image 19 in FIG. 2, the surface tends to have luster, with inferior writing characteristics. Since the colorless portion at the surface of the printing layer 2 where the transferred image is not recorded is required to have the same characteristic as that on the surface of the image receiver, such portion is poor in the aspects of image quality and writing characteristics when it has luster over all the surface.

Here, as shown in FIG. 3, if the rough concave and convex portions similar to those on the original surface of the image receiver are reproduced, the luster and writing characteristics on the surface of the printing layer become similar to those of the original surface of the image receiver. Therefore, an unnatural feel may be eliminated, and characters, etc. can be written from above the printing layer by a pencil or the like. Moreover, by the rigid fixing of the printing layer onto the image receiver, the fixing characteristics of the printing image may also be improved.

As is seen from the above description, since the printing apparatus according to the present invention includes the ink sheet, the intermediate transfer member having the printing layer on one surface of the base member, the printing means for effecting thermal transfer printing from the ink sheet to the printing layer, the transfer means for transferring the printing layer onto the image receiver in a state where the intermediate transfer member is overlapped with the image receiver, and the fixing means for fixing the printing layer on the image receiver by pressure and/or heat, the printed image may be recorded on any image receiver in which the printing layer will produce transfer characteristics. With respect to the image quality, printing at a high image quality may be effected even on an image receiver which was conventionally incapable of achieving uniform printing due to a rough surface. Moreover, a printed image favorable in its fixing quality may be obtained against friction on the surface of the image receiver. Due to the fact that the rough concave and convex portions of the image receiver are reproduced in the surface state, the unnatural appearance at the portion where only the colorless printing layer without having recorded images is present on the image receiver is eliminated, and characters and the like may be written from above the recording layer by a pencil or the like. Furthermore, by the rigid fixing of the recording layer onto the image receiver, the fixing characteristics of the printed image may be further improved.

It is to be noted here that, in the foregoing embodiment, although the intermediate transfer member is formed by providing the printing layer on the sheet-like base member, with respect to the formation of the printing layer, the construction may be arranged so as either to feed the intermediate transfer member preliminarily applied with the printed layer and discard the base member upon completion of the printing, or supply the printing layer repeatedly onto a base member provided in an endless shape, completed for transfer by a printing layer supply means. Moreover, as shown in a modified printing apparatus in FIG. 5, the intermediate transfer member may have a drum-like configuration made of metal, plastic material, etc. In the above case, the printing layer 2 is repeatedly fed onto the drum-like base member 20 by the printing layer supply means. As the printing layer supply means, for example, the printing layer 2 is formed on the B base member 4 of the ink sheet 6 in the face order with the ink material layer 5, and the printing layer 2 is transferred onto the surface of the drum-like base member 30 through heating by the thermal head 8, and thereafter a primary printed image 18 is formed on the printing layer 2 on the surface of the drum-like base member 20 by the ink material layer 5. By providing a heat generating portion therein, the drum-like base member 30 serves also as the platen 7 and heating roller 12 in FIG. 1, and the transfer means for transferring the printing layer onto the image receiver is constituted by the heat generating portion and the A roller 13.

Figure 5:
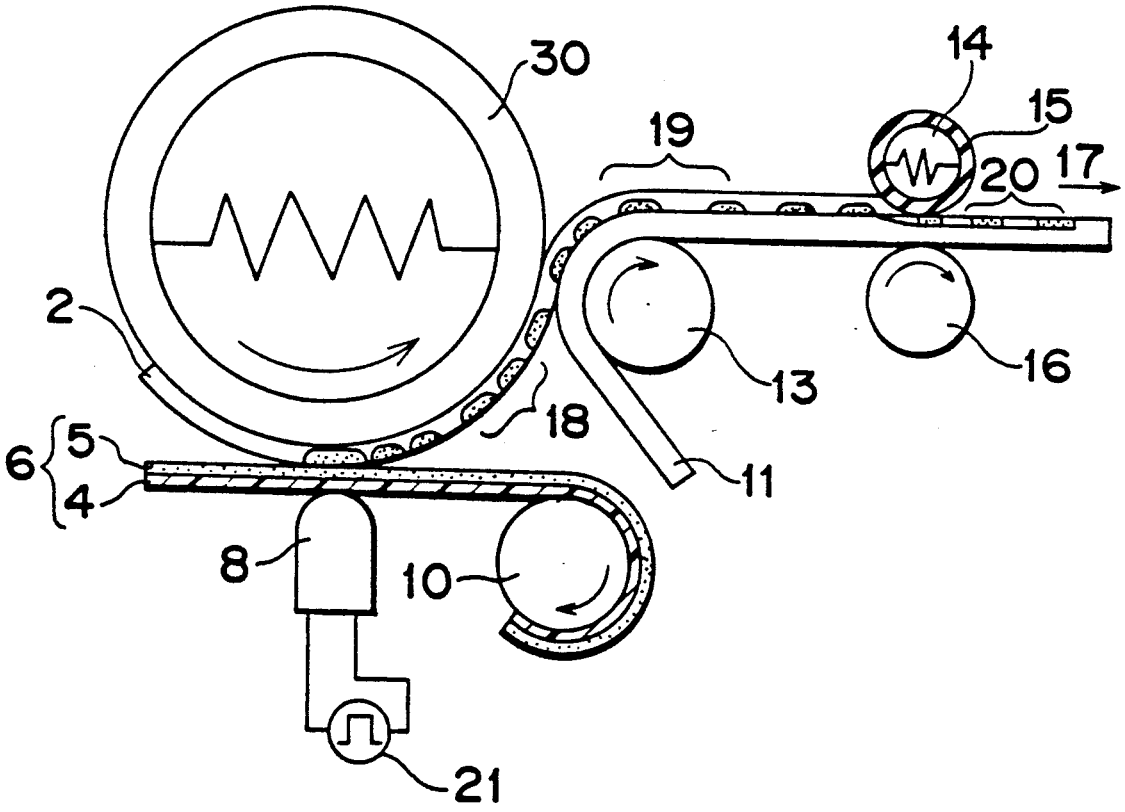
FIG. 5 is also a view similar to FIG. 1, which particularly shows a modification of FIG. 1 with respect to an intermediate transfer member.

Since other constructions and functions of the modified printing apparatus of FIG. 5 are generally similar to those of the printing apparatus described with reference to FIG. 1, detailed description thereof is abbreviated here for brevity, with like parts being designated by like reference numerals.

It should also be noted that the printing means is not particularly limited as the means for effecting thermal transfer printing, but an electric current passing head, an optical head or the like may be employed besides the thermal head of the present invention. Meanwhile, the heating roller 12 employed as the transfer means in the foregoing embodiment may be replaced by a member applying heat or pressure or both, or by another member based on the transfer principles above. The heating roller 12 is a roller having a heat generating portion in its interior or on its outer peripheral portion, and can be controlled in the heat amount to be transmitted to the side of the intermediate transfer member 3 from its surface though heat conduction by controlling the degree of energization of the heat generating portion. For the heat generating portion, a light source such as a halogen lamp or the like having large heat radiation may also be employed. As the material for the heating roller 12, for example, rubber (rubber coating), a plastic roll, a metallic roll, etc. are useful. Similar materials can also be applied to the A roller 13, which may be arranged to effect heating depending on necessity. It is also possible to transfer only the necessary portions of the printing layer 2 (e.g. only the portion for the primary printed image 18 of the printing layer 2) onto the image receiver 11.

Similarly, the pressure roller 14 provided with the rubber layer 15 on its surface and used as the fixing means in the foregoing embodiment may be replaced by other members applying pressure and/or heat. By effecting the fixing, the printing layer 2 is filled into the concave portions of the image receiver 11 to increase the bonding force, with a consequent improvement of the fixing characteristic.

For applying pressure, it is particularly desirable to provide a soft rubber layer 15 on the surface so as to effect the fixing, following the concave and convex portions on the surface of the image receiver 11. As the rubber layer 15, a material having a sufficient elasticity which will not vary to a large extent, even if pressure and heat are provided, is preferable. By employing a rubber material having a rubber hardness in the range of 10° to 70°, a favorable fixing characteristic is available, and particularly, if the rubber material has a hardness in the range of 10° to 25°, a superior fixing characteristic can be obtained even when the image receiver has large concave and convex portions on the surface.

Since the rubber layer is required to be fully deformed, following the concave and convex portions on the surface of the image receiver 11, it is desirable that the thickness of the rubber layer 15 is as large as possible. In plain paper sheet having a comparatively rough surface, the depth of the concave portion is about 25 μm, and therefore the fixing is possible if the rubber layer 15 has a thickness larger than about 25 μm.

Additionally, it is preferable that the rubber material should have a high parting characteristic in order to prevent adhesion with respect to the printing layer 2. Silicone rubber is composed, for example, of row rubber, filling agent, various additives, silicone oil, etc., and is very superior in its parting characteristics in rubber materials. By employing silicone rubber, optimized in film thickness, hardness, strength, surface smoothness, parting characteristics, etc. for the rubber layer 15, the fixing may be effected by following the concave and convex portions on the surface of the image receiver 11, while the adhesion of the printing layer onto the surface of the pressure roller during separation between the image receiver 11 and the pressure roller 14 can also be eliminated. As the materials for the B roller 16, for example, rubber materials (a rubber coating), a roll, a plastic roll and a metallic roll, etc. are useful, with an arrangement for heating being provided depending on necessity. The application of pressure during heating is further effective. More specifically, the printing layer is softened by the heating so as to be readily penetrated into the fine interior of the material fibers of the concave portions 3 of the image receiver. Particularly in the case where the heating temperature is above the lowest flow softening point of the thermo-plastic resin of the printing layer, the layer is further softened to have fluidity for penetration far into the concave portions on the surface of the image receiver, and thus the rubber layer 15 for applying pressure does not require much softness, and thus, it may be of a hard or very thin rubber material or parting material.

Meanwhile, in a case where the fixing is effected only by heating without applying pressure, the printing layer penetrates into among the fibers of the image receiver through capillary action by the softening owing to heating and the reduction of viscosity of the printing layer. For effecting heating, heat resistance of the material of the pressure roller 14 is required. Silicone rubber is very superior in heat-resistance, and is suitable for the material of the rubber layer 15.

By reducing the distance between the heating roller 12 and pressure roller 14, the pressure may be applied by the pressure roller 14 before the printing layer 2, softened by the heating roller 12, is lowered in temperature so as to be hardened. In such a case, an effect equivalent to heating is available even if the heating is not particularly effected by providing a heater in the interior, etc. of the pressure roller 14, thus making it possible to simplify the apparatus.

It should be noted here that although not shown in FIG. 1, the intermediate transfer member 3 may be constituted as a cassette member in which it is wound around a pay-out roll and a take up roll. The ink sheet 6 may also be constructed in a similar manner to the above.

The heat-resistant A base member 1 and B base member 4 in the form of sheets are of various kinds of high polymer films subjected to surface treatment by similar high polymer films, or coatings thereof. For the various kinds of high polymer films, there are available, for example, films of the polyolefin group, polyamide group, polyester group, polyimide group, polyether group, cellulose group, polyparabanic acid group, polyoxadiazole group, polystyrene group and fluorine group, etc. Particularly, various films of polyethylene terephthalate (PET), polyethylene naphthalate, aramide, triacetyl cellulose, polypropylene, cellophane, etc. are useful. The thickness of the high polymer films should normally be in the range of about 3 to 100 μm, and particularly be in the range of 3 to 30 μm. Each kind of high polymer films may be provided, at its one side face, with an anchor coating layer for better adhesion with respect to the printing layer, or a heat-resistant layer of thermo-setting resin and the like for improving heat-resistance of the high polymer film, e.g. resistance against thermal deformation, etc., or an electrical charging prevention layer, or various kinds of coating layers depending on necessity.

It is particularly desirable that the A base member 1 for the ink sheet is provided, at least at its one side face, with a lubricating layer or lubricating heat-resistant layer, since the stability of the member during movement with respect to the printing head is improved in that case. Moreover, it is preferable to employ as a base member a high polymer film provided with an adhering layer or separating layer depending on the characteristic of the coloring material layer. For example, in the case of a coloring material layer containing a subliming pigment, a high polymer film having an adhering layer (anchor coating layer) is useful.

The ink material layer 5 is composed at least of a coloring material and a binder material, with the coloring material to be employed not being particularly limited. As the coloring material for the subliming transfer, a dispersing dye, a basic dye and a color former, etc. are useful. Meanwhile, as the coloring material for the melting transfer, various kinds of pigments and dyes, etc., may be used. The binder material is not particularly limited, and various kinds of high polymer materials and waxes can be utilized. The ink material layer may be of a multi-layer construction. Furthermore, a lubricating layer and various kinds of coating layers may be provided on the ink material layer. Similarly, various kinds of additives such as silicone group materials and fluorine group materials, etc. may be added to the ink material layer.

The printing layer 2 is composed at least of a high polymer material. For example, in the case where the ink material layer 5 contains a coloring material for subliming transfer, since a dyeing property is required, high polymer materials to be easily dyed by dispersing dyes, etc., e.g. a polyester group resin, polyacetal group resin, acrylic group resin, urethane group resin, nylon group resin, vinyl acetate group resin, and vinylbutyral resin, etc. are useful. As materials which may satisfy the dyeing property of the dye and adhesion to paper, etc., there are available polyester group resin and vinylbutyral resin. Upon consideration of the parting or releasing characteristic from the PET film, vinylbutyral resin is superior. In the case where the ink material layer 5 is intended for melting transfer, there may be contained various thermal softening substances, surface active agents, and various kinds of particles, etc. for facilitating thermal adhesion with respect to the ink material layer.

For the image receiver, non-coated or coated paper of high quality, plain paper (for copying and the like) such as high quality paper, plain paper, bond paper, etc., films of polyethylene, polypropylene (PP), polyethylene terephthalate (PET), aluminum foil, etc., synthetic paper mainly composed of polypropylene, polyethylene terephthalate, and polyvinylchloride, a continuous image receiver or a cut image receiver and the like, may be employed without any limitation to the material, paper quality and configuration, etc., thereof.

As described so far, according to the thermal transfer printing method of the present invention, uniform definite images can be obtained by employing as the image receiver any type of printing paper, such as plain paper, transparent film for OHP, bond paper having a rough surface, coated paper, coated film, etc. Particularly, high quality printing, which is one of the features of the subliming type printing, and which has been nearly impossible up to the present with plain paper, can be realized by the method of the present invention.

Hereinbelow, examples are given for the purpose of describing the present invention, without any intention of limiting the scope thereof.

EXAMPLE 1

For the ink sheet, a paint containing an azoic dispersing dye, a saturated polyester resin, and a silicone group parting agent was coated, by a wire bar, onto a PET film 4 μm thick having a lubricating heat-resistant layer on its undersurface for subsequent drying to form an ink material layer of about 1 μm in thickness. Meanwhile, for the intermediate transfer member, vinylbutyral resin with a flow softening point at 160° C. (manufactured by Sekisui Chemical Col, Ltd.) was coated, by a wire bar, onto a PET film of 9 μm in thickness for subsequent drying to form a printing layer of about 2 μm thick.

Thereafter, the ink sheet and the intermediate transfer member overlapped each other, with the ink material layer directed to confront the printing layer, were held between the thermal head and platen, pressed against each other under a pressure of about 3 kg, and printing was effected under the following printing conditions.

Printing speed: 33.3 ms/line

Printing pulse width: 2–8 ms

Maximum printing energy: $6J/cm_2$

After printing, upon separation of the ink sheet from the intermediate transfer member, a gradient pattern was clearly recorded on the printing layer. Then, in a state where a plain paper sheet (copy paper sheet) of A4 size was piled upon the above printing layer, the intermediate transfer member and the plain paper sheet were passed between a metallic roll coated with rubber on its peripheral surface and heated up to about 180° C. and another metallic roll as the transfer means (pressure between the rolls: about 5 kg) to thereby transfer the printing layer onto the plain paper sheet, which was subsequently passed between a metallic roll coated on its surface with silicone rubber with a rubber hardness of 20° and a thickness of 0.6 mm and another metallic roll without any coating as the fixing means (pressure between said rolls: about 800 kg), and thus, the printed layer was fixed on the plain paper sheet.

The transferred image on the plain paper sheet thus obtained had a reflection printed density of 1.6 at a pulse width of 8 ms, and was of a high image quality, with dots of uniforms shape from low printed density to high printed density. Moreover, the luster of the printed layer was the same as that on the paper surface, without any unnatural appearance from the view point of image quality. Furthermore, the surface of the printed layer had the same writing characteristic as that of the surface of the paper.

EXAMPLE 2

Through employment of the ink sheet and the intermediate transfer member as used in Example 1, images were printed on the printing layer in the similar manner as in Example 1, and the printing layer was transferred onto the plain paper sheet. Thereafter, the printing layer was fixed on the plain paper sheet by passing it through between a rubber coated metallic roll provided on its surface with silicone rubber having a rubber hardness of 20° and thickness of 0.6 mm, and set at a surface temperature of 150° C. by a halogen lamp disposed therein, and another metallic roll without any coating as the fixing means (pressure between the rolls: about 80 kg).

The image thus obtained was similarly of a high quality as in Example 1. The luster of the printing layer was the same as that on the paper surface, without any unnatural appearance in the quality of the image, while the surface of the printing layer had the same writing characteristic as that on the surface of the paper. Since the pressure of the fixing means may be reduced, the apparatus was simple in construction, and still more natural luster was obtained without any tendency of the luster to be higher than that of the image receiver before the treatment.

EXAMPLE 3

Through employment of the ink sheet and the intermediate transfer member as used in Example 1, images were printed on the printing layer in a similar manner as in Example 1, and the printing layer was transferred onto the plain paper sheet. Thereafter, the printing layer was fixed on the plain sheet by passing it through between a rubber coated metallic roll provided on its surface with silicone rubber having a rubber hardness of 70° and a thickness of 0.6 mm, and set at a surface temperature of 170° C. by a halogen lamp disposed therein, and another metallic roll Without any coating as the fixing means (pressure between the rolls: about 40 kg).

The image thus obtained was similarly of a high quality as in Example 1. The luster of the printing layer was the same as that on the paper surface, without any unnatural appearance in the quality of image, while the surface of the printing layer had the same writing characteristic as that on the surface of the paper. By raising the heating temperature above the flow softening point of the printing layer, the pressing force of the fixing means may be reduced, with a high rubber hardness. Processing of the rubber roll may thus be facilitated with high reliability, and natural luster was obtained without any tendency of the luster to be higher than that of the image receiver before the treatment.

EXAMPLE 4

Through employment of the ink sheet and the intermediate transfer member as used in Example 1, images were printed on the printing layer in a similar manner as in Example 1, and the printing layer was transferred onto the plain paper sheet. Thereafter, the printing layer was fixed on the plain paper sheet by passing it through between two metallic rolls set at a surface temperature of 180° C. by a halogen lamp disposed therein as the fixing means, in a low speed state, where the surface of the printing layer was not depressed by the rolls.

The image thus obtained was of a similarly high image quality as in Example 1. The luster of the printing layer was the same as that on the paper surface, without any unnatural appearance in the quality of image, while the surface of the printing layer had the same writing characteristic as that on the surface of the paper. Since the pressing force of the fixing means is not required, the apparatus was simple in construction, and the transportation of the image receiver was also readily effected.

EXAMPLE 5

As the ink sheet, a melting transfer ink material layer of a wax type was provided on the upper surface of a PET film (about 4 μm thick). Then, the intermediate transfer member was prepared by forming a printing layer of about 2 μm in thickness made of vinylbutyral resin on a PET film of about 9 μm in thickness.

Thereafter, the ink sheet and the intermediate transfer member were overlapped with each other, with the ink material layer directed to confront the printing layer, were held between the thermal head and platen pressed against each other under a pressure of about 3 kg, and the ink material layer was transferred onto the recording layer under the following printing conditions.

Printing speed: 33.3 ms/line

Printing pulse width: 2–8 ms

Maximum printing energy: 2 J/cm$_2$

Subsequently, in a state where a plain paper sheet was piled upon the above printing layer, the intermediate transfer member and the plain paper sheet were passed between heating rolls in a similar manner as in Example 1 to thereby transfer the printing layer onto the plain paper sheet, which was subsequently passed between a metallic roll coated on its surface with silicon rubber with a hardness of 20° and a thickness of 0.6 mm and set for its surface temperature at 150° C. by a halogen lamp disposed therein and another metallic roll without any coating as the fixing means (pressure between said rolls: about 80 kg), and thus, the printed layer was fixed on the plain paper sheet.

The image thus obtained was of a high quality, and was not affected by the concave and convex portions of the plain paper sheet. Moreover, the luster of the printed layer was the same as that on the paper surface, without any unnatural appearance from the view point of image quality. Furthermore, the surface of the printed layer had the same writing characteristics as that on the surface of the paper. Even when the surface of the printed layer was rubbed by fingers, there was no change in the transferred images.

As is clear from the foregoing description, according to the present invention, by providing the ink sheet, the intermediate transfer member having the printing layer on one surface of the base member, the printing means for effecting thermal transfer printing from the ink sheet to the printing layer, the transfer means for transferring the printing layer onto the image receiver in a state where the intermediate transfer member is overlapped with the image receiver, and the fixing means for fixing the printing layer on the image receiver by pressure and/or heat, characters and images of a high image quality without an unnatural appearance in luster, etc. and superior in writing and fixing characteristics may be recorded on any image receiver in which the printing layer will produce transfer characteristics.

Although the present invention has been carefully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A thermal transfer printing method, comprising the steps of:

providing an ink sheet;

providing an intermediate transfer member comprising a base member and a printing layer on said base member;

overlapping the surface of said printing layer of said intermediate transfer member with said ink sheet;

effecting thermal transfer printing from said ink sheet to said printing layer;

providing an image receiver;

overlapping said intermediate transfer member with said image receiver and transferring said printing layer onto said image receiver from said intermediate transfer member; and maintaining the luster of the image receiver the same both before and after the printing layer has been transferred thereto by providing concave and convex portions on said image receiver by directly applying at least one of pressure and heat to said printing layer on said image receiver sufficient to cause said printing layer to penetrate into said image receiver.

2. The thermal transfer method of claim 1, wherein said step of providing an image receiver comprises providing said image receiver made of a material having fibers defining said convex and concave portions of said image receiver.

3. The thermal transfer method of claim 1, wherein in said step of fixing, only pressure is applied to said printing layer on said image receiver.

4. The thermal transfer method of claim 1, wherein in said step of fixing heat is applied to said printing layer on said image receiver.

5. The thermal transfer method of claim 1, wherein in said step of fixing, both heat and pressure are applied to said printing layer on said image receiver.

6. The thermal transfer method of claim 1, wherein in said step of fixing, said printing layer is fixed by a pressure roller having a surface covered with silicone rubber.

7. The thermal transfer method of claim 1, wherein said step of providing an intermediate transfer member further comprises having said printing layer comprise at least polyvinyl butyral.

8. A printing apparatus comprising:

an ink sheet;

an intermediate transfer member comprising a base member and a printing layer on said base member;

a printing means for effecting thermal transfer printing from said ink sheet to said printing layer of said intermediate transfer member;

an image receiver having a surface with concave and convex portions;

a transfer means for overlapping said intermediate transfer member with said image receiver and transferring said printing layer onto said image receiver from said intermediate transfer member; and a fixing means for fixing said printing layer on said surface of said image receiver such that the luster of said image receiver is maintained the same both before and after said printing layer is transferred thereto by directly applying at least one of pressure and heat to said printing layer on said image receiver sufficient to cause said printing layer to penetrate into said image receiver.

9. The printing apparatus of claim 8, wherein said image receiver comprises fibers defining said convex and concave portions of said surface.

10. The printing apparatus of claim 8, wherein said fixing means applies pressure only to said printing layer on said image receiver.

11. The printing apparatus of claim 8, wherein said fixing means applies heat to said printing layer on said image receiver.

12. The printing apparatus of claim 8, wherein said fixing means applies both heat and pressure to said printing layer on said image receiver.

13. The printing apparatus of claim 8, wherein said fixing means comprises a pressure roller having a surface covered with silicone rubber.

14. The printing apparatus of claim 8, wherein said printing layer comprises at least polyvinylbutyral.

* * * * *